United States Patent [19]

Heyraud

[11] 3,999,742

[45] Dec. 28, 1976

[54] ROTARY JAR-TYPE POWDER HOMOGENIZER

[75] Inventor: Jacques Heyraud, Aix-en-Provence, France

[73] Assignee: Commissariat a l'Energie Atomique, Paris, France

[22] Filed: Jan. 2, 1976

[21] Appl. No.: 646,099

[30] Foreign Application Priority Data

Jan. 2, 1975 France ..... 75.00049

[52] U.S. Cl. ..... 259/54; 141/270

[51] Int. Cl.[2] ..... B01F 9/00

[58] Field of Search ..... 259/54, 57, 12, 29, 259/49, 56, 91, 96, DIG. 24, 1 R, 30, 31, 32, 33, 34, 57, 58, 14, 15, 16; 141/270

[56] References Cited

UNITED STATES PATENTS

| | | | |
|---|---|---|---|
| 755,216 | 3/1904 | Carrier | 259/49 |
| 3,559,960 | 2/1971 | Elder | 259/58 |

*Primary Examiner*—Harvey C. Hornsby
*Assistant Examiner*—Donald B. Massenberg
*Attorney, Agent, or Firm*—Sughrue, Rothwell, Mion, Zinn & Macpeak

[57] ABSTRACT

A number of jars containing powders to be homogenized are fixed in a corresponding number of peripheral openings formed in a mixer housing, means being provided for conveying the jars to and away from the mixer. A jar-sealing valve is caused by actuating cams to undergo in alternate sequence and in accordance with a predetermined program a plurality of successive cycles of opening and closure when each jar is located above the mixer during a movement of rotation through an angle Â. After homogenization, a plurality of successive cycles of opening and closure of the sealing valve take place when each jar is located beneath the mixer during a movement of rotation through an angle B̂.

8 Claims, 1 Drawing Figure

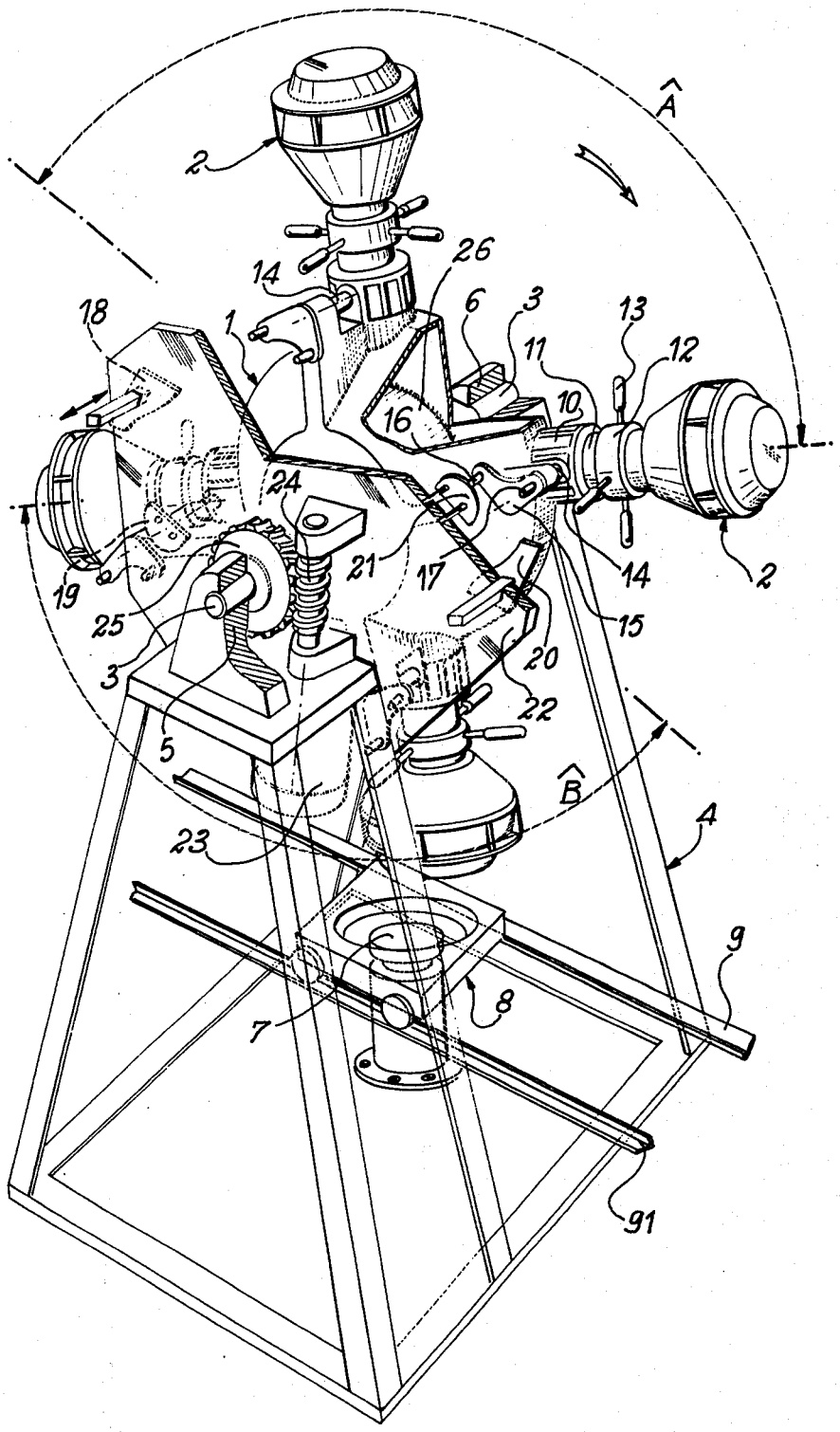
A
2
26
14
18
1
6
3
13
11
12
10
16
24
21
17
14
2
19
25
15
3
20
22
5
B
23
4
9
8
7
91

ROTARY JAR-TYPE POWDER HOMOGENIZER

This invention relates to a powder homogenizer which finds applications in all the industries in which it is desired to manufacture products from homogeneous powders and especially in the fabrication of nuclear fuels.

The invention is concerned with a powder homogenizer which essentially comprises a mixer constituted by a housing fitted with means for driving said housing in rotation about a shaft mounted horizontally on a frame. One characteristic feature of the homogenizer lies in the fact that a predetermined number of peripheral openings are formed in the housing and the necks of a corresponding number of jars containing the powders to be homogenized are fixed in said openings, means being provided for transferring the jars to the base of the mixer and discharging them as soon as the homogenization process is completed. Another feature lies in the fact that a valve which serves to seal the neck of each jar is caused by actuating cams to undergo in alternate sequence and in accordance with a predetermined program a plurality of successive cycles of opening and closure when said jar is located above the mixer during a movement of rotation through an angle $\hat{A}$; on completion of the homogenization process, a plurality of successive cycles of opening and closure of said sealing valve then take place when the jar is located beneath the mixer during a movement of rotation through an angle $\hat{B}$.

The jars are transferred by means of a carriage which is displaceable on two rails and are brought towards the mixer by means of a lifting platform placed vertically beneath said mixer.

The mixer is driven in rotation by a motor which is fixed on the frame, the driving shaft of said motor being in the form of a worm disposed in meshing engagement with a pinion which is rigidly fixed to the mixer shaft.

Provision is made for two sets of actuating cams, namely a first set of cams for discharging the contents of the jars into the mixer and a second set for discharging the contents of the mixer into the jars. Each set comprises two cams consisting of a stationary cam and a movable cam which is capable of moving in the direction of the mixer and parallel to the mixer shaft.

The valve for sealing the neck of each jar is associated with a shaft whose extremity is fitted with a rocker-arm having two arms at right angles each adapted to carry a terminal stud on that side of said rocker-arm which is remote from the shaft, said stud being adapted to cooperate with the actuating cams.

By virtue of this arrangement of the homogenizer, the powder charge contained in each jar is partially discharged into the mixer when said jar undergoes a movement of rotation through the angle $\hat{A}$. The emptying operation is completed after a predetermined number of revolutions.

Similarly, when the homogenization process is completed, the homogenized powder contained in the mixer is partially discharged from said mixer into the jar which is located in the bottom position in the angle $\hat{B}$.

The essential advantage of said homogenizer lies in the fact that, apart from the operations of attachment and detachment of the jars which continue to be performed by hand, the remaining sequence of operations is automatic and takes place without any interruption of leak-tightness.

It is also worthy of note that, in practice, the same jar serves to collect on the one hand the different powders to be mixed and, on the other hand, the mixture of these powders after homogenization. The resultant saving of containers is highly appreciable in an industrial production.

Further characteristic features and advantages of the invention will become apparent from the following description which is given by way of explanatory illustration without any limitation being implied, reference being made to the single accompanying FIGURE.

As can be seen from this FIGURE, the homogenizer comprises a mixer 1 which is shown in partial cross-section and has the shape of a drum constituted by a central cylindrical portion surrounded by two frusto-conical end portions. Said mixer can be of the barrel type with internal fins. Four identical jars 2 are attached to the mixer in leak-tight manner.

The shaft 3 of the mixer is supported on a frame 4 by means of bearings 5 and 6. A lifting platform 7 of the electric type or operated by means of a hydraulic jack is placed vertically beneath the mixer.

The transfer of jars is performed by a carriage 8 which moves along two rails 9 and 9' which are fixed on the frame 4 in a horizontal plane between the mixer and the lifting platform.

The mixer 1 has four peripheral openings each located in the line of extension of the other and each having an outwardly projecting sleeve 10 provided with an extension in the form of a threaded cylindrical portion 11. Each cylindrical portion is adapted to cooperate with a clamping collar 12 which is fitted with four handles 13 arranged crosswise and is fixed on the neck of each jar.

The sleeve 10 is fitted internally with a rotary valve (not shown in the FIGURE), the rotation of said valve being carried out by means of the shaft 14, the extremity of said shaft being adapted to carry a valve rocker-arm 15 in the form of a bell-crank lever. Two studs 16 and 17 are provided at the ends of said rocker-arm on the side remote from the shaft 14.

Four valve rocker-arms 15 are thus provided and these latter are continuously located in the same vertical plane.

Each rocker-arm 15 cooperates alternately with two sets of two actuating cams. One of the sets comprises a movable cam 18 and a stationary cam 19 whilst the other set comprises a movable cam 20 and a stationary cam 21.

The two sets of cams are supported by a vertical wall 22 which is rigidly fixed to the frame 4 and the two movable cams which are intended to carry out a horizontal movement of displacement are controlled by means of a device which is not illustrated and is rigidly fixed to the frame 4 or the wall 22.

The mixer is driven in rotation by a motor 23 which is mounted on the frame 4 and has a shaft 24 in the form of a worm which is disposed in meshing engagement with a pinion 25 which is rigidly fixed to the mixer shaft 3.

In the case of mixing of fissile materials, a mixer of annular shape can readily be provided by introducing a solid core 26 constituted by neutron-absorbing material such as a mixture of boron-containing plaster and polyethylene. The operation of the homogenizer involves the following steps:

I. Attachment of the jars to the mixer

The jars containing the ground powders are placed by hand one by one on the carriage 8 and conveyed by this means along the rails 9 and 10 to a position above the lifting platform 7. The jar is then displaced upwards until its neck can be fixed on the mixer by rotating the clamping collar 12 by means of the handles 13. The mixer is then rotated by one-quarter of a revolution in order to permit attachment of the following jar.

During the initial rotation of the mixer for the attachment of the jars, the cams are in a position in which they do not produce action on the valves which accordingly remain in the closed position.

II. Emptying of the jars

When the mixture has attained its normal speed of rotation, the engagement of the movable cam 18 is then initiated; said cam is moved to a distance from the wall 22 and placed on the path of the stud 17 of the rocker-arm 15 and this has the effect of opening the valve of the jar; this valve remains in the open position during rotational displacement of the jar through an angle $\hat{A}$ of approximately 120°.

The stud 16 comes into contact with the cam 21 which accordingly closes the valve. The contents of each jar are therefore progressively discharged each time the jar is located in the top position corresponding to the angle $\hat{A}$.

III. Homogenization

The cam 18 is withdrawn. The mixer which is isolated from the jars by the valves in the closed position performs the necessary number of revolutions.

IV. Emptying of the mixer

The opening of each jar is initiated when this latter is located beneath the mixer, that is to say while it passes through an angle $\hat{B}$ which is diametrically opposite to the angle $\hat{A}$. To this end, the movable cam 20 is engaged and thus permitted to cooperate with the stud 17 as soon as said cam comes into contact with this latter.

V. Detachment of the jars

The rotation of the homogenizer is stopped and the reverse operation of detachment is then performed.

The part played by the different cams during the operation of the homogenizer can be summarized in the following table.

| | 1st revolution (attachment) | jar-emptying revolutions | homogenization revolutions | mixer-emptying revolutions |
|---|---|---|---|---|
| stationary cam 19 | without action | without action | without action | closure |
| cam 18 | non-engaged | engaged: (opening) closure | non-engaged | non-engaged |
| stationary cam 21 | without action | | without action | without action |
| cam 20 | non-engaged | non-engaged | non-engaged | engaged: (opening) |

It is readily apparent that, apart from the operations of attachment and detachment of the jars, all the homogenization operations contemplated in the foregoing can be controlled automatically in accordance with a well-determined program.

It will be understood that the invention is not limited by the foregoing description of the homogenizer but extends to all modifications which remain within the definition of equivalent technical means.

In particular, the number of jars may be other than four.

Furthermore, in all cases in which the composition of the powders gives rise to problems of criticality, it may be an advantage to employ a mixer of annular shape.

What we claim is:

1. A powder homogenizer essentially comprising a mixer constituted by a housing fitted with means for driving said housing in rotation about a shaft mounted horizontally on a frame, wherein a predetermined number of peripheral openings are formed in said housing and the necks of a corresponding number of jars containing the powders to be homogenized are fixed in said openings, means being provided for transferring the jars to the base of the mixer and discharging them as soon as the homogenization process is completed, and wherein a valve which serves to seal the neck of each jar is caused by actuating cams to undergo in alternate sequence and in accordance with a predetermined program a plurality of successive cycles of opening and closure when said jar is located above the mixer during a movement of rotation through an angle $\hat{A}$, whereupon a plurality of successive cycles of opening and closure of said sealing valve then take place on completion of the homogenization process when the jar is located beneath the mixer during a movement of rotation through an angle $\hat{B}$.

2. A powder homogenizer according to claim 1, wherein provision is made for two sets of cams each comprising two cams consisting of a stationary cam and a movable cam which is capable of moving in the direction of the mixer and parallel to the mixer shaft.

3. A powder homogenizer according to claim 2, wherein the valve for sealing the neck of each jar is associated with a shaft whose extremity is fitted with a rocker-arm having two arms at right angles each adapted to carry a terminal stud on that side of said rocker-arm which is remote from the shaft, said stud being adapted to cooperate with the actuating cams.

4. A powder homogenizer according to claim 1, wherein the angles $\hat{A}$ and $\hat{B}$ are diametrically opposite.

5. A powder homogenizer according to claim 1, wherein the jars are transferred by means of a carriage which is displaceable on two rails and are brought towards the mixer by means of a lifting platform placed vertically beneath said mixer.

6. A powder homogenizer according to claim 1, wherein the mixer is driven in rotation by a motor which is fixed on the frame, the driving shaft of said motor being in the form of a worm disposed in meshing engagement with a pinion which is rigidly fixed to the mixer shaft.

7. A powder homogenizer according to claim 1, wherein the mixer is constituted by a cylindrical central portion surrounded by two frusto-conical end portions.

8. A powder homogenizer according to claim 1, wherein the mixer is of annular shape.

* * * * *